US009080584B2

(12) United States Patent
Fröschle et al.

(10) Patent No.: US 9,080,584 B2
(45) Date of Patent: Jul. 14, 2015

(54) PNEUMATIC CYLINDER HAVING A SELF-ADJUSTING END POSITION DAMPING

(75) Inventors: Axel Fröschle, Stindelfingen (DE); Peter Rohatschek, Metzingen (DE); Thomas Henke, Kongen (DE); Rainer Schweizer, Filderstadt (DE); Alexander Buchhauser, Grabenstetten (DE)

(73) Assignee: PARKER-HANNIFIN MANUFACTURING GERMANY GMBH KG, Bielefeld (DE)

( * ) Notice: Subject to any disclaimer, the term of this patent is extended or adjusted under 35 U.S.C. 154(b) by 204 days.

(21) Appl. No.: 13/533,333

(22) Filed: Jun. 26, 2012

(65) Prior Publication Data

US 2013/0001031 A1 Jan. 3, 2013

(30) Foreign Application Priority Data

Jun. 28, 2011 (DE) ..... 10 2011 051 400

(51) Int. Cl.
*F15B 15/20* (2006.01)
*F15B 15/22* (2006.01)

(52) U.S. Cl.
CPC ..... *F15B 15/222* (2013.01); *F15B 15/204* (2013.01)

(58) Field of Classification Search
CPC ..... F15B 15/204; F15B 15/222
USPC ..... 188/275, 322.13–322.15; 267/64.28
See application file for complete search history.

(56) References Cited

U.S. PATENT DOCUMENTS

| | | | | |
|---|---|---|---|---|
| 3,933,080 | A | 1/1976 | Corrie | |
| 5,440,968 | A * | 8/1995 | Sekine | 92/6 R |
| 6,474,215 | B1 * | 11/2002 | Boyer et al. | 92/23 |
| 8,100,046 | B2 * | 1/2012 | Tunkers | 91/395 |
| 2005/0062206 | A1 * | 3/2005 | Antonovsky | 267/64.11 |
| 2008/0289920 | A1 | 11/2008 | Bruder | |
| 2011/0079142 | A1 * | 4/2011 | Albrecht et al. | 92/181 R |

FOREIGN PATENT DOCUMENTS

| | | | |
|---|---|---|---|
| AT | 213677 | B | 2/1961 |
| DE | 2244764 | A1 | 4/1973 |
| DE | 2326417 | A1 | 12/1974 |
| EP | 1998054 | A2 | 12/2008 |

* cited by examiner

*Primary Examiner* — Anna Momper
(74) *Attorney, Agent, or Firm* — Renner, Otto, Boisselle & Sklar, LLP

(57) ABSTRACT

A pneumatic cylinder having end position damping of the cylinder piston is controlled by means of a vent path and a control valve, the control valve comprises a control piston, the control side of which is pressurized by a pneumatic pressure which exists in a control chamber. The movement of the control piston into its closing position is pneumatically controlled by the increasing pressure in the damping chamber during the beginning of the damping. No additional components or controls are to be provided, so that the control of the end position damping occurs exclusively by the pressure conditions prevailing at the time when the damping begins.

16 Claims, 5 Drawing Sheets

PNEUMATIC CYLINDER HAVING A SELF-ADJUSTING END POSITION DAMPING

CROSS REFERENCE TO RELATED APPLICATIONS

This application claims priority under 35 U.S.C. §119 to German patent application DE 10 2011 051 400.7, filed Jun. 28, 2011, the disclosure of which is incorporated herein by reference.

TECHNICAL FIELD

The present invention relates to a pneumatic cylinder with a cylinder housing with a cylinder piston which reciprocates within it under the action of pressure, on which a working pressure is respectively applied in one of its direction of movement by means of a connection duct which alternatively acts as pressure duct and as a vent duct and replaces the air which exists with a lower release pressure on its respective opposite side of the cylinder interior from the cylinder interior, were at least at one end of the cylinder piston stroke a damping arrangement with a damping chamber which is arranged in a cylinder interior and which is bounded by the reciprocating cylinder piston is arranged, which for the end position damping of the cylinder piston is ventilated controlled by means of a vent path with a control valve which is connected in it, wherein the pneumatically controlled control valve comprises a control piston, the control side of which facing away from the vent path is pressurized by a pneumatic pressure which exists in a control chamber.

A pneumatic cylinder which is provided with end position damping for its cylinder piston with the above-mentioned features is known from EP 1 998 054 A2. In this instance, a damping pin in the end zone of the cylinder housing which is closed off by a cylinder cover with a pneumatic cylinder without a piston rod is provided which extends axially into the cylinder housing, onto which the reciprocally movable cylinder piston in the cylinder housing strikes with a recess that is formed in it. A connection duct for the cylinder interior extends through the damping pin, by means of which either compressed air can be supplied at a working pressure to cause the movement of the cylinder piston away from the damping pin, or through which the air that is displaced during the movement of the cylinder piston towards the damping pin is discharged from the cylinder interior. The damping phase begins at the instance when the cylinder piston strikes against the damping pin, wherein in the embodiment described in EP 1 998 054 A2, the damping chamber is formed by the annular space that surrounds the damping pin. For the purpose to drain off the air occluded in the damping chamber after the damping phase begins, the damping chamber is connected with the connection duct by means of the vent path forming an air vent. A pneumatically controlled control valve is connected into the air vent with a control piston that can be moved in its swept volume which on its control side is respectively pressurized by the working pressure acting on the cylinder piston. This accomplishes that at the time at which the pressure which increases with increasing travel of the cylinder piston into the damping chamber exceeds the existing working pressure, the control valve enables the air vent, so that the air in the damping chamber can flow out and an end position damping for the cylinder piston is produced.

The disadvantage connected with the known end position damping is that the beginning of the venting of the damping chamber is determined by the working pressure which exists in each case, i.e. that a venting of the damping chamber will occur only if the pressure which exists and/or increases in it is greater and/or becomes greater than the working pressure. Consequently, only a small energy range is available for performing the damping. At the same time it must be considered that during the movement of the cylinder piston in the direction of the damping pin, a decompression has already occurred in the damping chamber, because during the movement of the cylinder piston, the air displaced from the cylinder interior is discharged via the associated connection duct. In this respect, only a significantly lower release pressure still exists in the damping chamber. Particularly, when the pressure increases only gradually during respective higher working pressures or such that due to slow travel of the cylinder piston and the damping chamber it consequently takes quite long until a pressure in the damping chamber is reached which exceeds the working pressure, and therefore the damping behavior of the known damping arrangement is insufficient.

BACKGROUND OF THE INVENTION

The purpose of the invention is therefore to improve the damping behavior of a pneumatic cylinder with the generic features during the end position damping.

The solution of this problem results from the content of the Claims including advantageous embodiments and developments of the invention, which follow this description.

In its fundamental idea the invention provides that the control chamber of the control valve is connected with an area of the damping arrangement in which release pressure exists and that a closure arrangement with a controlled closure element is connected in the duct connection by means of which the respective release pressure which exists at the time by means of which the begin of the damping which is characterized by an increase in pressure in the damping chamber can be an trapped in the control chamber and such acts as a fixed control pressure onto the control piston of the control valve and defines the opening time of the control valve for the enabling of the vent path.

The invention is therefore based on the advantageous principle, in that the pressure which respectively exists in the damping chamber at the beginning of the damping is normally lower than the working pressure, is used as a threshold for the beginning of the damping with the discharge of the air which still exists in the damping chamber, in that this pressure which respectively currently exists in the damping chamber and/or in the connection duct at the beginning of the damping is used for controlling the control valve which enables the vent path for the damping chamber. The invention teaches that accordingly the pressure on the ventilation site is determined as the control pressure for the control by means of the connection created between the control chamber of the control valve and the area of the damping arrangement in which release pressure exists, and this duct connection is interrupted by the controlled movement of the closure element at the beginning of the damping and therefore fixes the control pressure for the control valve. To this extent, the mode of operation of the end position damping is independent of the operating method of the pneumatic cylinder, whether with faster or with slower piston travel, since the invention teaches that exclusively the pressure which exists on the side of the ventilation at the time when the damping begins, is important. As a result, this substantially increases the energy range and/or working range of the damping device as taught by the invention

SUMMARY OF THE INVENTION

According to embodiments of the invention, the controlled movement of the closure element can be performed in different ways. To begin with, it can be provided that the movement of the closure element is electrically controlled depending on a tapped off control signal at the beginning of the damping. In this instance, the pressure increase in the damping chamber is captured separately, and as a result of the corresponding signal the closure element is moved into a position in which it closes the control chamber of the control valve.

In an alternative embodiment of the invention it can be provided that the movement of the closure element is mechanically controlled by the movement of the cylinder piston relative to the cylinder housing. For this purpose, a pin which is mechanically applied to move the closure element into its closing position relative to the control chamber of the control valve can be arranged such, for example, that when reaching a position of the cylinder piston at which the damping begin should occur, the pin comes into contact with the closure element and shifts same during a further movement of the cylinder piston.

Pursuant to a preferred embodiment it is provided that the movement of the closure element of the closing arrangement into its closing position which closes the control chamber of the control valve is pneumatically controlled by the increasing pressure in the damping chamber during the beginning of the damping. This has the advantage that no additional components or controls are to be provided, so that the control of the end position damping occurs exclusively by the pressure conditions prevailing at the time when the damping begins.

For this purpose, according to an embodiment of the invention it can be provided that the closure element is designed as a piston element which can be longitudinally moved in the swept volume, wherein on the pressure side of the closure element facing away from the direction of the closure movement the pressure is applied which exists in the damping chamber in each case and the pressure zone which exists on the opposite side of the closure element is connected with the control chamber of the control valve. According to embodiments of the invention, for this purpose the piston element can be formed as a solid piston or even as a diaphragm.

The structural design of an end position damping as taught by the invention and which is exclusively pressure controlled can preferably be realized with a design of the pneumatic cylinder as it is described in the category-defining EP 1 998 054 A2, in which in the area of the end stop of the cylinder piston, a damping pin which extends into the cylinder interior in the axial direction with a connection duct which leads through it is arranged and the cylinder piston is designed with a recess that accommodates the damping pin.

For this purpose it can be provided in a first embodiment of the invention that the control valve and closure arrangement are arranged in the cylinder cover of the pneumatic cylinder.

In one such arrangement for end position damping in the cylinder cover in a first embodiment of the invention it is provided that the duct connection between the control chamber of the control and the area of the damping arrangement which has the release pressure is formed by a connecting duct which runs between the pressure zone of the closure arrangement which is connected with the control chamber and the connection duct, and that the vent path consists of an air vent which starts from the damping chamber and runs via the swept volume on the pressure side of the closure arrangement and via the control valve up to the connection duct, which is blocked against the damping chamber by the closure arrangement prior to that the damping begins. In this case, both the duct connection to the control chamber of the control valve as well as the vent path each are connected to the connection duct. Pursuant to a development of the invention it can be provided additionally that a stop valve in which the flow direction is from the control valve to the connection duct is connected in the section of the vent path which runs between the control valve and the connection duct Pursuant to an alternative embodiment it can be provided that the duct connection between the control chamber of the control valve and the damping chamber which has the release pressure before the damping begins is formed by a connecting duct which accommodates the closure arrangement, and that the vent path consists of an air vent which starts from the damping chamber and runs via the control valve up to the connection duct. In this instance, the vent path is again connected to the connection bore, while the duct connection for feeding the pressure which exists at the beginning of the damping into the control chamber of the control valve is now connected to the damping chamber.

Pursuant to a further embodiment of the invention it can be provided that the control valve and closure arrangement are arranged in the cylinder piston of the pneumatic cylinder. In this embodiment, the same arrangement of control valve and closure arrangement and the same conduction paths can be set out as described in connection with the above-mentioned embodiment.

Individually it can be provided that the duct connection between the control chamber and the area of the damping arrangement which has the release pressure is formed by a connecting duct which runs between the pressure space of the closure arrangement connected with the control chamber and the recess of the cylinder piston, and that the vent path consists of an air vent which starts from the damping chamber and runs via the swept volume on the pressure side of the closure arrangement and via the control valve up into the recess of the cylinder piston, which is blocked by the closure arrangement against the damping chamber prior to the beginning of the damping.

Alternatively it can be provided that the duct connection between the control chamber of the control valve and the damping chamber which has the release pressure before the damping begins is formed by a connecting duct which accommodates the closure arrangement, and that the vent path consists of an air vent which starts from the damping chamber and runs via the control valve up to the recess of the cylinder piston.

Refinements of the invention may provide that the control piston of the control valve is arranged without a seal relative to the vent path in the valve body of the control valve. This enables makes ventilation of the damping chamber via the control valve with a limited and/or low flow cross-section, a situation that applies especially in cases where a slow movement of the cylinder piston results in only very low pressure differentials between the damping pressure in the damping chamber as of the beginning of the damping and the initial end [sic] release pressure that is fixed as the control pressure for the control piston of the control valve, and thus the control piston is not moved into its position releasing the cross-section of the end [sic] vent channel which runs via the control valve.

According to an embodiment of the invention it can be provided furthermore that the control piston of the control valve and the closure element of the closure device are respectively held by assigned spring arrangements in a defined starting position prior to that damping begins. Such type of defined starting position of control piston and closure element can also be accomplished in alternative embodiments and also by the connection of control elements, such as stock valves or the like into the respective flow paths, or by adjusting respective area ratios or by the use of differential pistons or diaphragms.

Pursuant to an embodiment of the invention it can be provided that the control piston of the control valve and the closure element of the closure arrangement are arranged by the arrangement of additional duct connections which are respectively arranged pressure compensated prior to the beginning of the damping.

BRIEF DESCRIPTION OF THE DRAWINGS

Embodiments of this invention will now be described in further detail with reference to the accompanying drawings, in which:

FIG. 2 is the cylinder cover of the pneumatic cylinder pursuant to

FIG. 1 with an end position damping arranged in it;

DETAILED DESCRIPTION OF THE INVENTION

Figure 1:
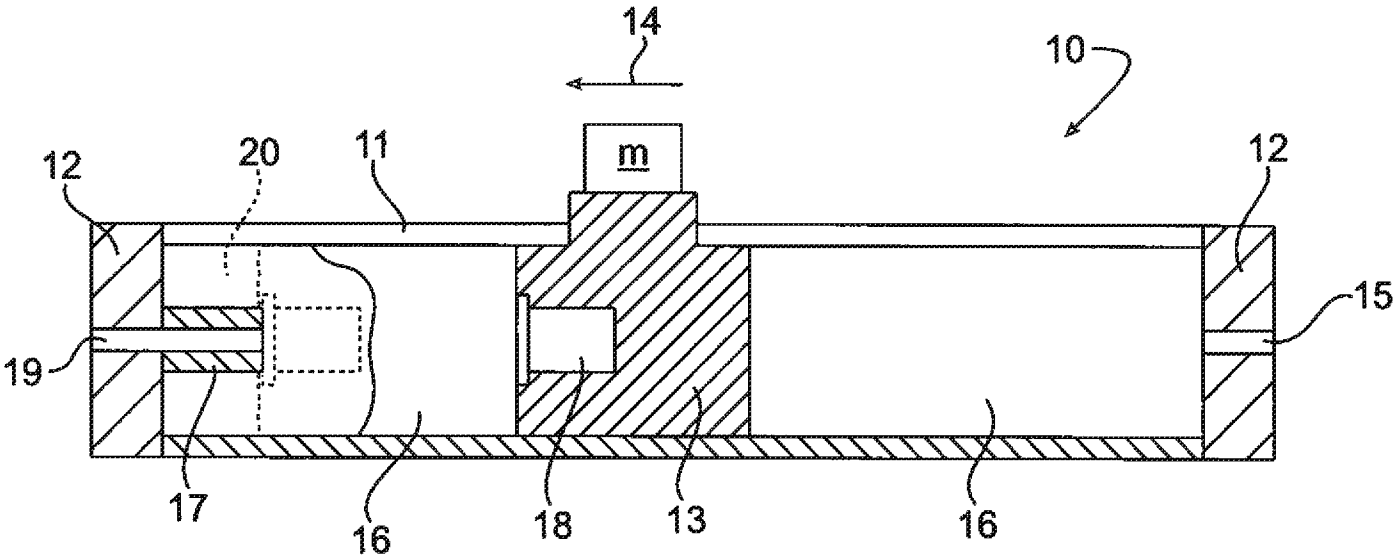
FIG. 1 is a pneumatic cylinder without a piston rod as an example for the application of the end position damping as taught by the invention, as a schematic embodiment.

The fundamental structure of a pneumatic cylinder 10 with position damping is described in EP 1 998 054 A2. In a cylinder housing 11 which is closed on both sides by the cylinder cover 12, a cylinder piston 13 is guided reciprocally movable as a carrier of a mass m. For its movement to the left in the direction of the arrow 14, compressed air at working pressure is supplied into the cylinder interior 16 via a connection duct 15 which penetrates the right cylinder cover 12 on the opposite side of the cylinder, an end position damping for the cylinder piston 13 is formed. For this purpose, a damping pin 17 which protrudes radially from the cylinder cover 12 into the cylinder interior 16 is formed, against which the cylinder piston 13 runs with a recess 18 that is formed in it. For venting the part of the cylinder interior 16 which is located in the direction of travel in the direction of the arrow 14, a connection bore 19 which extends through the damping pin 17 is provided. For this purpose, it is necessary that in order to traverse the cylinder piston 13 in the direction of the arrow 14, the left part of the cylinder interior 16 must be decompressed, so that the air displaced by the movement of the cylinder piston 13 can flow out via the connection duct 19. Therefore, during the travel of the cylinder piston 13 in the direction of the arrow 14, a release pressure exists in the left part of the cylinder interior which is lower than the working pressure. In FIG. 1, the dotted lines furthermore indicate the position of the cylinder piston 13 at the instant when it runs against the damping pin 17, wherein the desired damping phase of the respective set up position damping begins in this position. In this way, a damping chamber 20 is partitioned off between the cylinder cover 12 and the cylinder piston 13, in which the initially prevailing release pressure increases by the further movement of the cylinder piston 13 in direction of the arrow 14, wherein for performing the end position damping, the air which exist in the damping chamber 20 is also be to discharged by means of a vent path which is still to be described.

Figure 2:
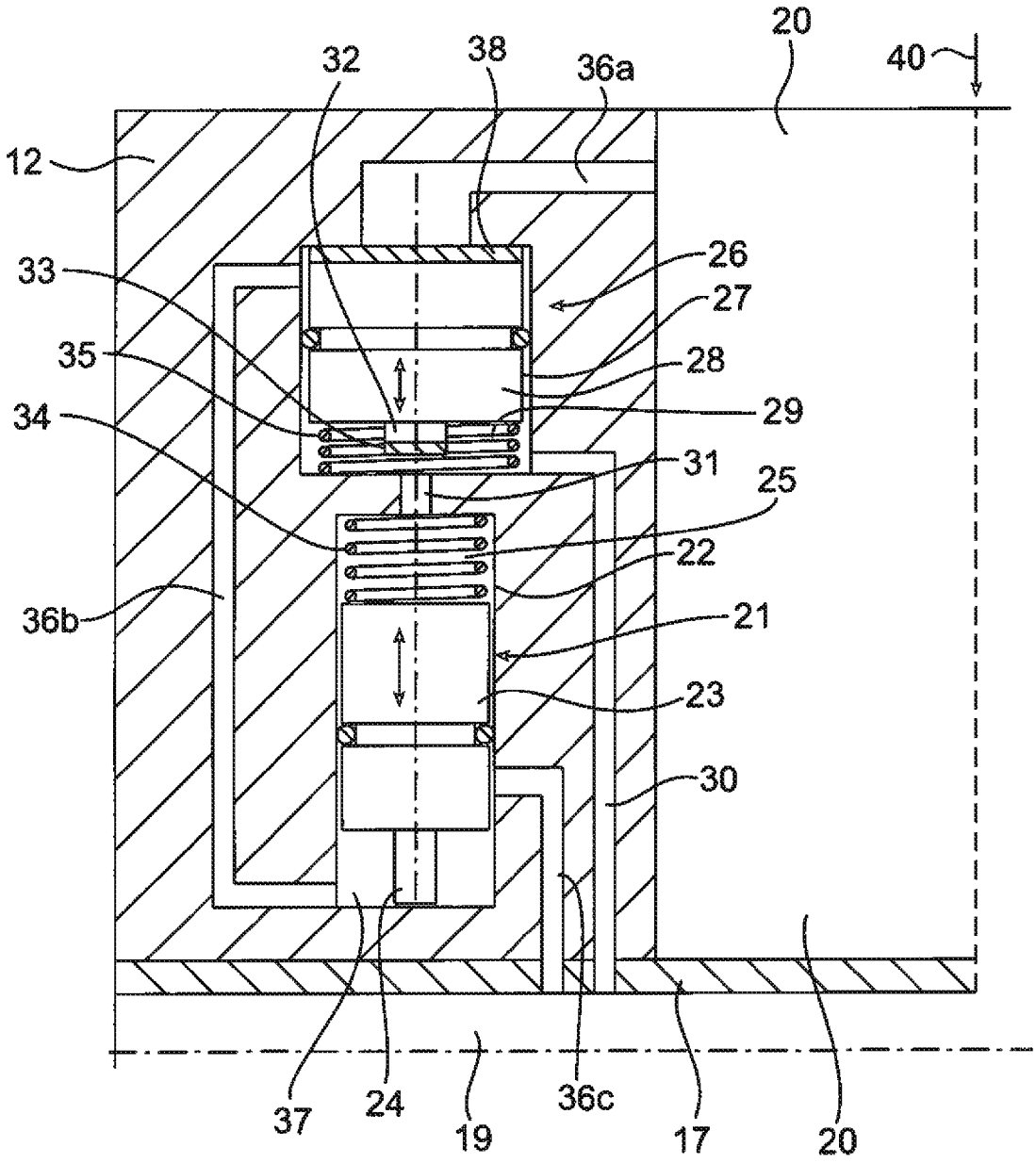

A first embodiment for such type of vent path including an end position damping for the movement of the cylinder piston 13 is illustrated in FIG. 2, in which the components of the end position damping are arranged in the left cylinder cover 12 shown in FIG. 1.

For this purpose, a control valve 21 is arranged in the cylinder cover 12 in the plunger chamber 22 of which a control piston 23 is movably arranged. On its one side, the control piston has a lug 24 as end stop for its movement in the plunger chamber 22. On the opposite side of the control piston 23, a control chamber 25 is arranged as a component of the plunger chamber 22, which is addressed in the following.

Furthermore, a closure arrangement 26 is formed in the cylinder cover 12 with a closure element 28 which is movably arranged in the swept volume 27. On the one side of the closure element 28 a pressure chamber 29 is formed, the one side of which is connected to the connection duct 19 via a duct connection 31 onto which the connection duct 19 formed in the damping pin 17 is connected. The pressure chamber is furthermore connected with the control chamber 25 of the control valve 21 by means of a connection bore 31, wherein this connection bore 31 can be closed in a corresponding position of the closure element 28 by means of a locking lug 32 and a sealing area 33 developed on it formed on the closure element 28.

For producing a fixed starting position, the control piston 23 of the control of 21 is biased by means of a spring 34 arranged in the control chamber 25, wherein in its neutral position the control piston 23 is biased by the spring 34 into its end position with a limit stop of the lug 24 against the wall of the piston chamber 22. Accordingly, also the closure element 28 is biased in its closing position 26 (still to be discussed) by means of a spring 35 arranged in the pressure chamber 29, in which the locking lug 32 of the closure element 28 releases the connection bore 31 between the pressure chamber 29 and the control chamber 25 of the control valve 21.

Finally, an air vent which consists of three sections 36*a, b, c*, is formed in the cylinder cover 12. In this context, the first section 36*a* of the damping chamber 20 leads into the swept volume 27 of the closure arrangement 26, wherein in the starting position, due to the bias of the spring 35, the closure element 28 with a sealing area 38 formed on it seals the swept volume 27 against the first section 36*a* of the air vent. From the swept volume 27, a second section 36*b* of the air vent then leads to the vent chamber 37 of the control valve 21 which is arranged opposite the control chamber 25 such that the exit of the second section 36*b* of the swept volume 27 of the closure arrangement 26 can be enabled by the closure element 28 in its displaced position. A third section 36*c* of the air vent leaves from the vent chamber 37 of the control of 21 to the connection duct 19 in the damping pin 17 such that in the starting position, the exit of the third section 36*c* of the air vent from the vent chamber 37 of the control piston 23 is covered but can be enabled by it in its displaced position.

However, during the movement of the cylinder piston 13 in direction of the damping pin 17 and the displacement of the existing air in the cylinder interior 16 via the connection duct 19 formed in the damping pin 17, the release pressure which is below the working pressure exists initially also in the control chamber 25 of the control valve 21 via the duct connection 30 in the pressure chamber 29 of the closure arrangement 26 and via the connection bore 31 which exists between the pressure chamber 29 and the control chamber 29 of the control valve 21. The release pressure which exists respectively in the pressure chamber 29 as well as in the control chamber 25 provides initially that the closure element 28 is supported pressure compensated, because the release pressure also exists on the clamping side, which is defined by the sealing area 38 of the closure element 28 of the closure arrangement 26, because the release pressure also exists via the first section 36*a* of the air vent. In this instance, the spring ensures the closing position of the closure element 28 opposite the first section 36*a* of the air vent. Insofar as the release pressure exists similarly also in the control chamber 25 of the control valve 21, an intentionally missing seal of the control piston 23 against the third section 36*c* of the air vent ensures that release pressure also exists in the vent chamber 37 of the control valve via the third section 36*c* of the air vent, wherein the control piston 23 is held in the defined starting position by the spring 34 which exerts pressure on it.

When the cylinder piston 13 now runs against the damping pin 17, as indicated with arrow 40 and the dotted line in FIG. 2, then the damping chamber 20 is initially sealed against any further venting via the connection duct 19, so that during any further movement of the cylinder piston 13, the pressure, now described as damping pressure, increases in the damping chamber 20. This pressure increase characterizes the beginning of the damping.

As described, the release pressure still exists in the system at the moment when the damping begins, particularly in the control chamber 25 of the control valve 21 and also in the pressure chamber 29 of the closure arrangement 26. The pressure which increases in the damping chamber 20 from when the damping begins now results in the pressurization of the closure element 28 via the first section 36*a* of the air vent, so that the closure element is moved into its closing position in which its locking lug 32 with its sealing area 33 closes the connection bore 31 to the control chamber 25 of the control valve 21. This fixes the release pressure increase which exists at the time of the pressure increase in the control chamber 25 in the damping room as the control pressure for the control piston 23. At the same time, by the closure movement of the closure element 28, the second section 36*b* of the air vent that leads away from the swept volume 27 of the closure arrangement 26 is enabled, so that the air displaced with increasing pressure from the damping chamber 20 enters into the vent chamber 37 of the control valve 21 via the sections 36*a, b* of the air vent and also ensures a pressure increase here. If this damping pressure which respectively exists in the vent chamber 37 because of the increasing pressure in the damping chamber 20 exceeds the release pressure occluded in the control chamber 25 of the control valve 21, then the control piston 23 is shifted into the control chamber 25 while enabling the third section 36*c* of the air vent which goes out from the vent chamber 37, so that the air displaced from the damping chamber 20 via the now enabled sections 36*a, b, c*, of the air vent flows up to the connection duct 19. Thus a pressure controlled and therefore damping discharge of the air that is displaced from the damping chamber 20 is given.

Cases can occur, in which, due to a very slow movement of the cylinder piston, there are only very small pressure differentials between the damping pressure which exists in the damping chamber 20 from the beginning of the damping and the initial release pressure fixed as the control pressure for the control piston 23 of the control valve 21, so that the control piston is not moved into its position which enables the cross-section of the vent path which is led via the control valve 21. In this process, the previously discussed restricted open flow cross-section caused by the missing seal of the control piston 23 against the third section 36*c* of the air vent serves to facilitate a run-off of the air displaced from the damping chamber 20 after the closure element 28 is opened, even if the position of the control piston 23 is not changed.

Although not further illustrated, the arrangement of the spring 34 which biases the control piston 23 is not necessary, if a stop valve in which the direction of flow is from the control valve 21 to the connection duct 19, is connected into the third section 36*c* of the air vent. In this case, no pressure exists in the vent chamber 37 of the control valve 21 prior to the beginning of the end position damping, so that the control piston 23 is retained in its defined position which initially blocks the third section of the air vent which goes out from the vent chamber 37 by the release pressure provided into its control chamber 25.

Figure 3:
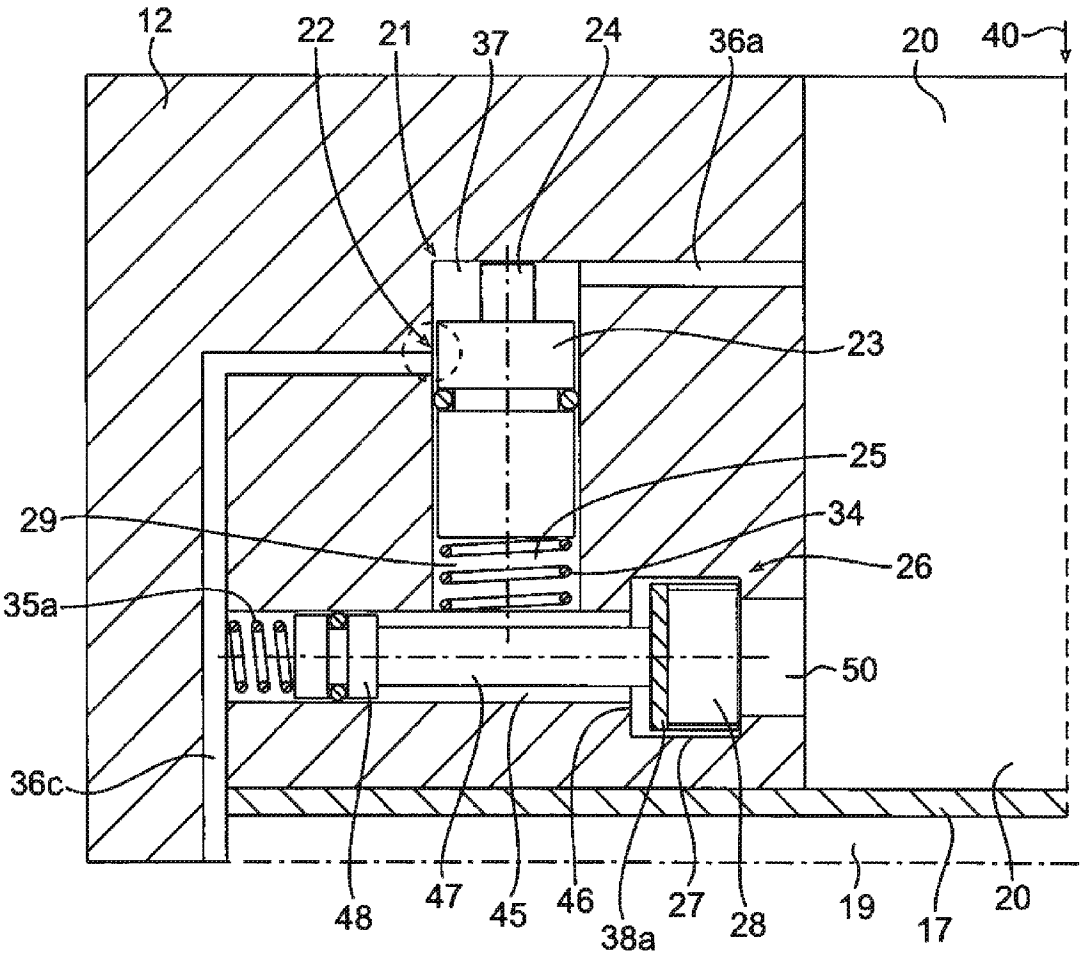
FIG. 3 is another embodiment of the end position damping illustrated in FIG. 2.

The embodiment illustrated in FIG. 3 distinguishes itself from the previously described embodiment by a changed arrangement of control valve 21 and enclosure arrangement 26 in the cylinder covered 12 as well as by the connection of the duct connection 30 between the pressure chamber 29 of the closure arrangement 26 and therefore also the control chamber 25 of the control valve 21 directly on the damping chamber 20. In this instance, the air vent is no longer lead via the closure arrangement, but rather still only a section 36*a* of the air vent is provided which leads from the damping chamber 20 to the vent chamber 37 of the control valve, and a section 36*c* which leads from the vent chamber 37 to the connection duct 19 of the damping duct. Prior to the beginning of the damping by the control of 21 and/or its control piston 23, this vent path is essentially blocked against the damping chamber 20, wherein as described in connection with FIG. 2, however, because of the missing seal of the control piston 23 against the wall of the control chamber 22 in the area of the inlet of the section 36*c* of the air vent, an outflow path is also available in cases in which during slow travel of the cylinder piston 13 there is only a very small pressure differential that adjusts itself between the damping pressure and the release pressure fixed as control pressure.

The closure arrangement 26 arranged in the cylinder cover 12 is connected with the damping chamber 20 via a feed line 50. In the swept volume 27 of the closure arrangement 26, the closure element 28 is conducted in an unsealed manner, so that the air which exists in the damping chamber 20 initially flows past the closure element 28 into a duct section 45 which is connected with the control chamber 25 of the control valve 21. The closure position 28 for closing-off the control chamber 25 against the damping chamber 20 is formed by a seal seat 46 between the swept volume 27 of the closure arrangement 26 and the duct section 45, on which the closure element 28 sits in its closure position with the sealing area 38*a* which is formed on it. The duct section 45 is furthermore connected continuously with the section 36*c* of the air vent, wherein in the area of the duct section 45 between the section 36*c* of the air vent and the connection of the control chamber 25 of the control valve 21, a pressure plunger 48, which is connected with the closure element 28 by means of a rod 47, is guided in a sealing manner, which for its part is biased by a spring 35*a* in a position of the closure element 28, in which the closure element 28 is lifted off from the seal seat 46 and therefore enables the flow path from the damping chamber 20 into the control chamber 25 of the control valve 21. Due to the connection of the duct section 45 with the section 36*c* of the air vent which is connected to the connection duct 19, because of the pressure which exists on both sides of closure element 28 and/or pressure plunger 48 prior to the beginning of the damping, this ensures a pressure compensated position of the closure element 28.

In principle, the same operational and functional conditions prevail as described in detail with reference to FIG. 2. The release pressure which exists in the damping chamber 20 at the beginning of the damping (arrow 40) on the one hand exists in the vent chamber 37 of the control valve 21 via the section 36*a* of the air vent. This release pressure continues to exist also in the swept volume 27 of the closure arrangement

26 of the closure arrangement 26, the duct section 45 and also in the control chamber 25 of the control valve 21 via the feed line 50 and the open flow path in the closure arrangement 26, so that both the control piston 23 as well as the closure element 28 are arranged pressure compensated. By means of their respective springs 34 and 35*a*, the control piston 23 and closure element 28 are respectively held in a defined starting position. If the pressure increases in the damping chamber 20, then the closure element 28 is again shifted in contact with its sealing area 38*a* on the seal seat 46, so that the release pressure which exists in the control chamber 25 of the control valve 21 at the time that the damping begins is occluded in the control chamber 25 and acts here as fixed control pressure for the control piston 23. The increasing pressure in the damping chamber 20 also exists in the vent chamber 37 of the control valve 21 via the section 36*a* of the air vent, and as soon as the damping pressure exceeds the control pressure of the control of 21 which is characterized by the release pressure, the control piston 23 is shifted into its position, in which it enables the connection of the section 36*c* of the air vent, so that the air which exists in the damping chamber 20 can flow off into the connection duct 19 via the vent path 36*a*, 36*c*.

Figure 4:
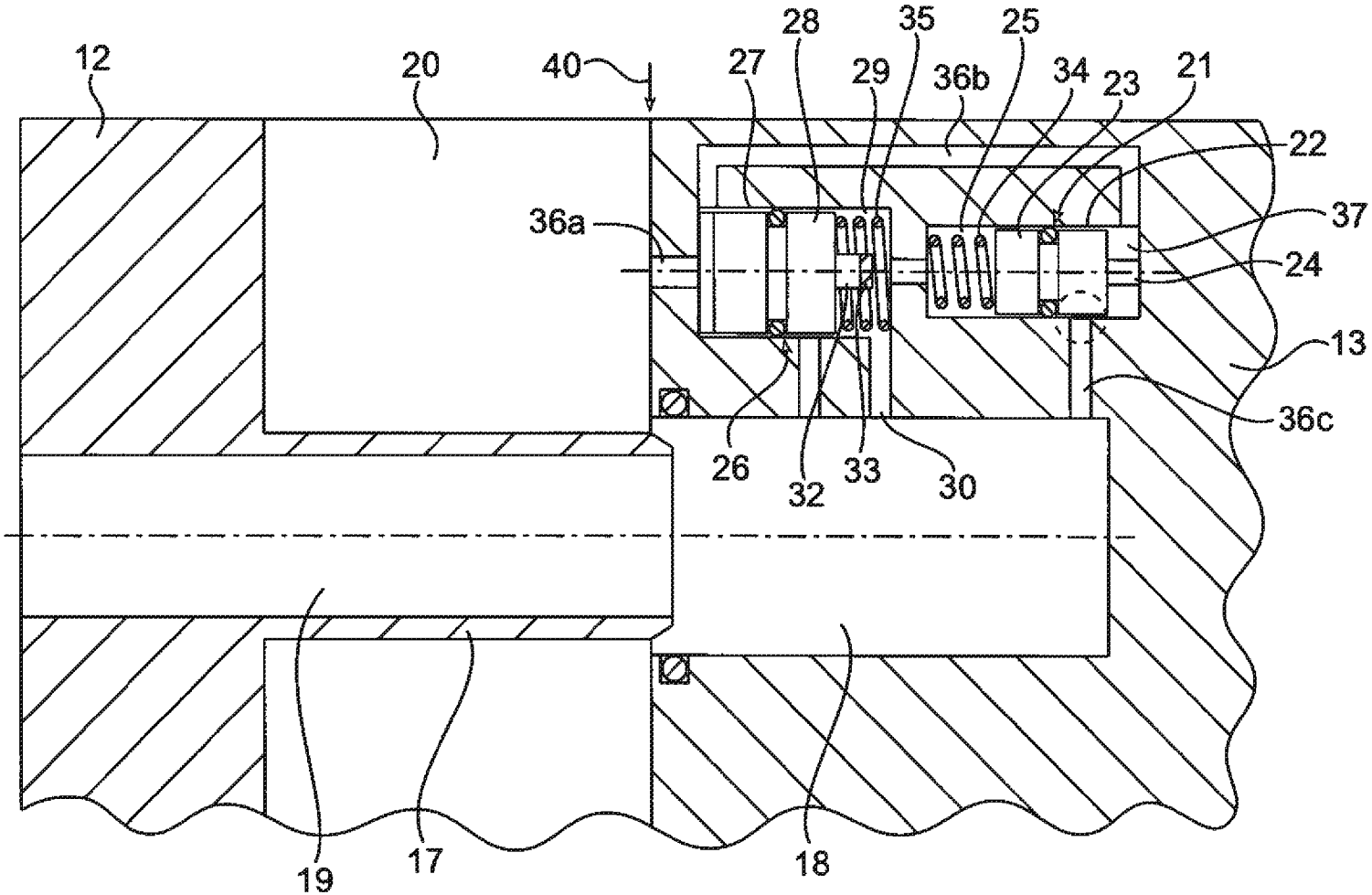
FIG. 4 is an embodiment of the invention with an end position damping arranged in the cylinder piston.
Figure 5:
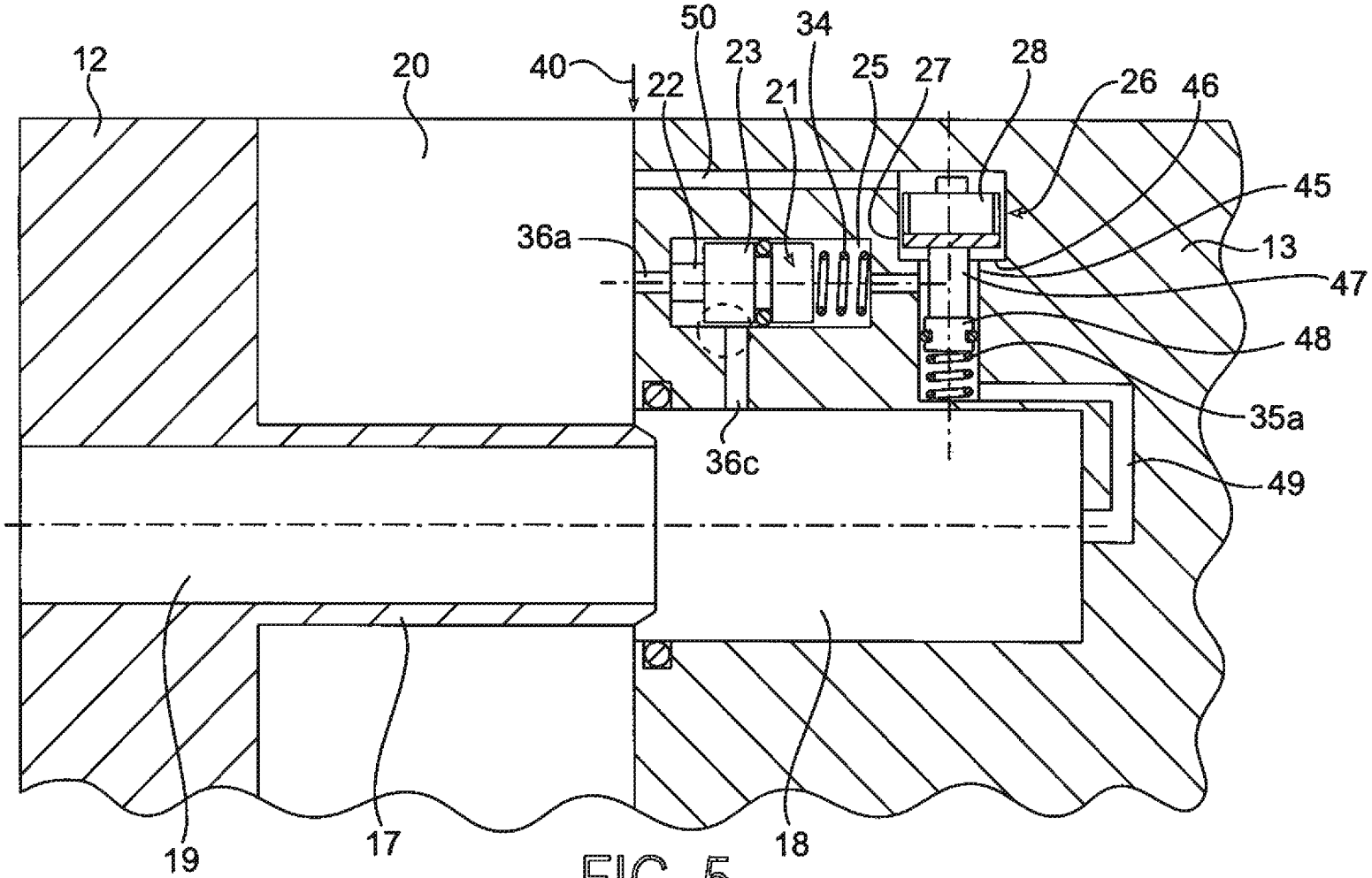
FIG. 5 is the subject matter of FIG. 4 in a modified embodiment.

In FIGS. 4 and 5, the respective arrangements, pursuant to the previously described embodiments pursuant to FIGS. 2 and 3, of control element 21 and closure arrangement 26 including the associated connection paths have now be relocated from the cylinder cover 12 (FIGS. 2, 3) into the cylinder piston 13, provided that with the respective embodiment pursuant to FIG. 4 corresponding to the embodiment pursuant to FIG. 2, the duct connection 30 as well as also the third section 36*c* of the air vent respectively terminate in the recess 18 formed in the cylinder piston 13, which, starting from the beginning of the damping while the cylinder piston 13 strikes the damping pin 17, becomes a component of the connection bore 19 which runs in the damping pin 17, by means of which the damping chamber 20 is vented. Otherwise, the same procedures are performed as described in connection with FIG. 2.

This applies accordingly also for the embodiment illustrated in FIG. 5, wherein for producing a pressure compensated position of the closure element 28 with pressure piston 48 prior to beginning the damping, in this case still an additional duct 49 between the duct section 45 and the recess 18 is formed.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

The invention claimed is:

1. A pneumatic cylinder comprising a cylinder housing and a cylinder piston which reciprocates within an interior of the cylinder housing, a connection duct for alternately applying working pressure to a respective side of the cylinder piston for causing the cylinder piston to move in one direction of movement of the cylinder piston and for releasing pressure for movement of the cylinder piston in an opposite direction of movement, and a damping arrangement associated with a damping chamber within the interior of the cylinder, the cylinder piston nearing an end stroke position closing the damping chamber from the connection duct, the damping arrangement including a vent path through which pressure from the damping chamber can be vented, a pneumatically controlled control valve connected to the vent path, the pneumatically controlled control valve including a control piston having a control side facing away from the vent path and which is pressurized by pneumatic pressure which exists in a control chamber, wherein the control chamber of the control valve is connected by a duct connection with an area of the damping arrangement that is connected to and disconnected from the duct connection by a closure arrangement including a controlled closure element that is movable to a closed position by pressure in the damping chamber, and wherein increasing pressure in the damping chamber acts on the control piston of the control valve for opening the vent path.

2. The pneumatic cylinder according to claim 1, wherein movement of the closure element is electrically controlled depending on a control signal tapped off at the beginning of damping of the cylinder piston.

3. The pneumatic cylinder according to claim 1, wherein movement of the closure element is mechanically controlled by relative movement of the cylinder piston to the cylinder housing.

4. The pneumatic cylinder according to claim 1, wherein the movement of the closure element into its closed position is pneumatically controlled by increasing pressure in the damping chamber at the beginning of damping of the cylinder piston.

5. The pneumatic cylinder according to claim 4, wherein the closure element is formed as a piston element that moves longitudinally in a swept volume, wherein the respective pressure which exists in the damping chamber is applied on a pressure side of the closure element facing away from the direction of closure movement and a pressure chamber on an opposite side of the closure element is connected with the control chamber of the control valve.

6. The pneumatic cylinder according to claim 4, including in the area of an end stop of the cylinder piston a damping pin, and the connection duct leads through the damping pin that extends in an axial direction into the interior of the cylinder housing, and the cylinder piston has a recess for receiving the damping pin.

7. The pneumatic cylinder according to claim 4, wherein the control valve and the closure arrangement are arranged in a cylinder cover of the pneumatic cylinder.

8. The pneumatic cylinder according to claim 7, wherein the closure element moves in a swept volume, and the vent path includes an air vent which starts at the damping chamber and runs via the swept volume of the closure arrangement and via the control valve to the connection duct, which air vent is blocked, prior to the beginning of damping, from the damping chamber by the closure arrangement.

9. The pneumatic cylinder according to claim 8, wherein a stop valve is provided in a section of the vent path that runs between the control valve and the connection duct, and the flow direction in such section is from the control valve to the connection duct.

10. The pneumatic cylinder according to claim 7, wherein the vent path consists of an air vent which starts at the damping chamber and runs via the control valve to the connection duct.

11. The pneumatic cylinder according to claim 4, wherein the control valve and the closure arrangement are arranged in the cylinder piston of the pneumatic cylinder.

12. The pneumatic cylinder according to claim 11, wherein the closure element moves in a swept volume, and the vent path has an air vent which starts at the damping chamber and runs via the swept volume and via the control valve to a recess of the cylinder piston, which is blocked by the closure arrangement against the damping chamber prior to the beginning of the damping.

13. The pneumatic cylinder according to claim 11, wherein a duct connection between the control chamber of the control valve and the damping chamber is formed by a connecting duct which accommodates the closure arrangement, and that the vent path consists of an air vent which starts at the damping chamber and runs via the control valve to the recess on the cylinder piston.

14. The pneumatic cylinder according to claim 1, wherein the control piston of the control valve is arranged in the valve body of the control valve without a seal in relation to the vent path.

15. The pneumatic cylinder according to claim 1, wherein the control piston of the control valve and the closure element of the closure arrangement are respectively held by spring arrangements in a defined starting position.

16. The pneumatic cylinder according to claim 1, wherein the control piston of the control valve and the closure element of the closure arrangement are respectively arranged pressure compensated by arrangement of additional duct connections prior to the beginning of the damping.

* * * * *